US005401134A

United States Patent [19]

Habicht et al.

[11] Patent Number: 5,401,134

[45] Date of Patent: Mar. 28, 1995

[54] TELESCOPING APPARATUS FOR LIFTING AND DISCHARGING OF CONTAINERS

[75] Inventors: Helmut Habicht, 15 Royal Park Terr., Hillsdale, N.J. 07642; John C. Lund, Waldwick, N.J.

[73] Assignee: Helmut Habicht, Hillsdale, N.J.

[21] Appl. No.: 218,269

[22] Filed: Mar. 25, 1994

[51] Int. Cl.[6] ..... B66F 9/06

[52] U.S. Cl. ..... 414/422; 414/420; 414/619; 414/639; 187/227

[58] Field of Search ..... 414/420, 422, 618, 619, 414/639, 742, 743; 187/9 R, 9 E

[56] References Cited

U.S. PATENT DOCUMENTS

| | | | |
|---|---|---|---|
| 3,174,634 | 3/1965 | Peck | 414/420 X |
| 3,191,788 | 6/1965 | Hopfeld | 414/420 |
| 3,549,033 | 12/1970 | Howard | 414/422 |
| 4,348,147 | 9/1982 | Helm | 414/420 |
| 4,797,050 | 1/1989 | Habicht | 414/420 |
| 4,954,037 | 9/1990 | Habicht | 414/422 X |
| 5,205,699 | 4/1993 | Habicht | 414/422 X |
| 5,330,032 | 7/1994 | Warner | 187/9 E |
| 5,344,275 | 9/1994 | Habicht | 414/422 X |

*Primary Examiner*—Michael S. Huppert
*Assistant Examiner*—James W. Keenan
*Attorney, Agent, or Firm*—Patrick J. Pinto

[57] ABSTRACT

A lifting apparatus for containers of a flowable material which comprises a base member, a first elongated tubular column, a second elongated tubular column, a container support, and a lifting and lowering assembly. The lifting and lowering assembly is housed interior of the second column and includes a reversible gear motor and an elongated lift bar. The gear motor selectively drives an endless flexible tension member by way of a drive member cooperating with a driven assembly. One end of the elongated lift bar is connected to a first segment of the flexible tension member. A distal end of the elongated lift bar is attached to a base assembly. The second elongated tubular column is selectively lifted or lowered with respect to the first tubular column, in telescopic fashion, as the flexible tension member is driven. The container support, which may have tilting capabilities, is attached to a moveable carriage member. The carriage member is attached to a second segment of the flexible tension member and is lifted or lowered at a selected rate simultaneously with the second elongated tubular column.

14 Claims, 3 Drawing Sheets

TELESCOPING APPARATUS FOR LIFTING AND DISCHARGING OF CONTAINERS

BACKGROUND OF THE INVENTION

1. Field of the Invention

With regard to the classification of art, this invention is believed to be found in the general class entitled "Material or Article Handling", and more particularly to an apparatus for lifting a container by way of a telescoping tubular column.

2. Description of the Prior Art The lifting of receptacles, containers, drums and the like are the subject of several U.S. patents. The closest known art related to the present invention are U.S. Pat. No. 4,797,050 issued to Habicht on Jan. 10, 1989 and U.S. Pat. No. 5,205,699 issued to Habicht on Apr. 27, 1993. Each of the listed patents is soley owned by a co-inventor and owner of the present invention. These patents are included by reference to the extent that the law allows.

Each of the prior U.S. patents teaches the use of a linear actuator for providing the lifting of the container. These prior art patents generally require that the linear actuator be powered by a compressed fluid. One of the disadvantages of using a linear actuator is that after a period of time leakage may occur at the piston and/or piston rod seal. Many times this leakage results in the contamination of the environment in which the apparatus is used. Any leakage also results in the consumption of power, additional to that which is required to perform the intended task. Another disadvantage associated with using a linear actuator is safety. It is necessary to provide a separate safety device or lock for ensuring the safety of workers in the vicinity of an apparatus employing a linear actuator.

The present invention overcomes the disadvantages recited above.

SUMMARY OF THE PRESENT INVENTION

The present invention may be summarized in part with respect to its objects. It is an object of the present invention to provide and it does provide a lifting apparatus for containers which employs a mechanical means for lifting a container.

It is another object of this invention to provide and it does provide a lifting apparatus for containers which is energy efficient.

It is a further object of this invention to provide and it does provide a lifting apparatus which includes a self-locking lifting and lowering means.

One embodiment of a telescoping apparatus for lifting and tilting a drum and like containers of flowable material placed on the apparatus includes a base assembly having a base member and first elongated tubular column. An axis of the first elongated tubular column is arrayed in a substantially vertical position with respect to the base member. A second elongated tubular column is configured so as to be slidably positioned within the first tubular column in telescopic fashion. A slot is formed in each of the first elongated tubular column and the second elongated tubular column. Each of the slots is in substantial alignment with each other while providing an access opening to the interior of the first elongated tubular column and the second elongated tubular column. A container support is adapted to receive and support the weight of the container. A means for retaining the container in a placed condition on the container support during lifting and any tilting of the container is provided. A movable carriage member positioned within the second elongated tubular column is also provided. The moveable carriage member has a plurality of guide rollers rotatably secured thereto. At least two U-shaped channel members are provided. Each of the U-shaped channel members is attached to opposing walls of the second elongated tubular column for providing guideways for each of the guide rollers secured to the moveable carriage member. A selectively actuated lifting and lowering means includes a reversible rotary gear motor. The gear motor is secured to a selected first interior portion of the second tubular column. A driven member assembly is rotatably secured to a selected second interior portion of the second tubular column. The reversible gear motor has at least one output shaft. A driver member is secured to each output shaft. A flexible tension member connects the driver member with the driven member assembly in a substantially endless array. An elongated lift bar has one of its ends attached to a selected portion of a first segment of the flexible tension member. A distal end of the elongated lift bar is secured to a selected portion of the base assembly. The second tubular column is selectively lifted and lowered with respect to the base assembly in response to a selective movement of the flexible tension member by the driver member. The carriage member is attached to a selected position of a second segment of the flexible tension member and is lifted at a selected rate as the second column is lifted.

In addition to the above summary, the following disclosure is detailed to insure adequacy and aid in the understanding of this invention. This disclosure, however, is not intended to cover each new inventive concept no matter how it may be disguised either by variations in form or additions by further improvements. For this reason, there has been chosen specific embodiments of a telescoping apparatus for the lifting and discharging of containers. The specific embodiments have been chosen for the purpose of illustration and description as shown in the accompanying drawings wherein:

Figure 1:
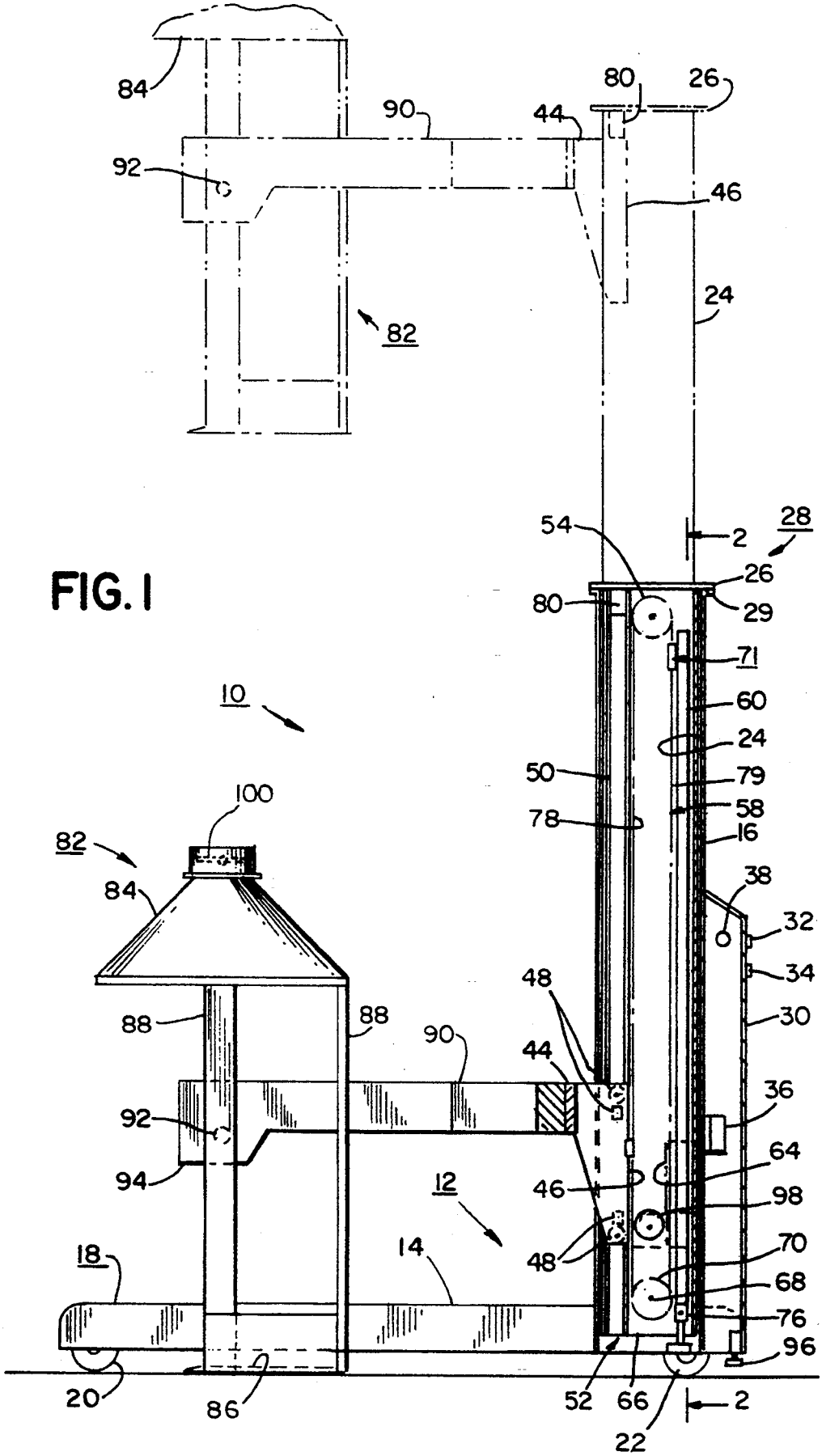
FIG. 1 represents a side elevational view of the apparatus of the present invention, this view being illustrated partly schematically and partly in section.

In the following description and in the claims, various details are identified by specific names for convenience. These names are intended to be generic in their application while differentiating between the various details. Corresponding reference characters refer to like members throughout the several figures of the drawings.

The drawing accompanying, and forming a part of this specification disclose details of construction for the sole purpose of explanation. It is understood that structural details may be modified without departing from the concept and principles of the invention. This invention may be incorporated in other structural forms than shown.

DESCRIPTION OF THE INVENTION

Referring to FIGS. 1, 2, 3, and 4, a lifting and tilting apparatus for a container and the like is generally identified as 10. This apparatus 10 has been illustrated as having mobile capabilities, but the apparatus may be used in a stationary application. Preferably, the apparatus 10 includes a base assembly 12. The base assembly 12 includes a base member 14 and a first elongated tubular column assembly 16. The base member 14 preferably includes a furcated extending portion 18 for permitting front loading or unloading of a container at floor level. This furcated arrangement may be seen more clearly in FIG. 4. The base member 14 preferably includes a pair of front wheels 20 and rear casters 22. The first tubular column 16 is attached to the base member 14 in a substantially vertical array. The first column 16 must be of sufficient length to support a second tubular column 24 in an extended condition. This second tubular column is configured and sized to be guided by the first tubular column 16 during selective telescopic positioning by an operator. The second tubular column 24 includes a cap 26 which acts as a stop. This cap 26 abuts an upper portion 28 of the first column 16 when the second column 24 is fully retracted. It is preferred that the upper portion 28 be reinforced with a flange 29 around its perimeter.

The lower portion of the first column 16 includes a housing 30 for mounting the operating controls such as lifting function control 32; tilting function control 34; and at least one control valve assembly 36. The lower portion of the first column 16 also includes a gripping means 38 in the form of a pair of extending handle members. A handle member extends from each side of the housing 30, as may be seen in FIG. 4. Preferably, one side of the gripping means 38 includes a conduit for introducing power to the controls of the apparatus 10. It has been found that compressed air is preferred as a power source. In which case all of the operating controls could be of the air logic type. It is to be noted that other types of a power source may be used such as A.C. or D.C. electricity.

Slots 40 and 42 are formed in each of the first column 16 and second column 24. Each of the slots 40 and 42 are in substantial alignment with each other. These slots 40 and 42 provide an access opening to an interior portion of the first column 16 and second column 24. The access opening provides a passageway for a container support mounting means 44. The container support mounting means 44 is carried by a carriage member 46. The carriage member 46 is linearly guided interior of said second elongated column 24 by a plurality of guide rollers 48. It is preferred that four pair of guide rollers be used. Each pair of guide rollers 48 have their axis displaced at 90 degrees to each other, for providing guidance in two directions. The guide rollers 48 are guided in a pair of U-shaped channel members 50. Each of the U-shaped channel members 50 is attached to opposing interior walls of the second column 24, which may be seen in FIG. 2.

The carriage member 46 is selectively lifted and lowered by a lift and lowering means. This lift and lowering means includes a reversible gear motor assembly 52; a driven assembly 54; at least one flexible tension means 58 and at least one elongated lift bar 60.

The gear motor assembly 52 is preferably mounted to a lower interior portion of the second column 24 by a suitable means such as threaded fasteners 62. This gear motor assembly 52 preferably includes a pneumatic motor 64 and right angle gear reducer 66. It is preferred that the right angle gear reducer 66 have two output shafts 68. Each output shaft 68 has a driver member 70 such as a roller chain sprocket secure thereto. Each flexible tension member 58 preferably is a roller chain which connects each driver member 70 with its associated portion of the driven assembly 54 is a substantially endless array.

One end of each lift bar 60 is attached to a first segment of its adjacent flexible tension member 50 at a selected position by an attachment means 71. Preferably this attachment means 71, as may be seen in FIG. 3, includes a plurality of threaded fasteners 72 and a clamping plate 74. Two of the threaded fasteners may be replaced with hardened pins for additional safety. The distal end of the lift bar 60 is pivotally and adjustably secured to the base assembly 12 by means of a clevis arrangement 76. This clevis arrangement 76 is adapted for allowing limited pivotal movement of the lift bar 60 as the upper end of the lift bar 60 moves from the vicinity of the driven assembly 54 to the vicinity of the driver means 70. The threaded adjustment of the clevis means 76 allows fine adjustments to compensate for manufacturing tolerances that may be present. It is preferred that a redundant system be used. This redundant system includes two flexible tension means 58 and two elongated lift bars 60.

Figure 3:
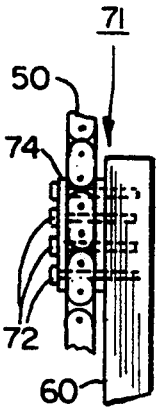
FIG. 3 represents a fragmentary side elevational view of a typical attachment means to a flexible tension member.

The carriage member 46 is attached to a second segment 78 of the flexible tension member 58 by a clamping arrangement similar to attaching means 71, shown in FIG. 3.

Referring now to FIG. 1, it can be seen that the gear motor assembly 52 may be selectively energized to lift or lower the second column 24. For example, each driver member 70 is rotated clock-wise to lift the second column 24 from a lower position. The attachment point of the lift bar 60 to the first segment 79 of the flexible tension means 58 will apply a force in a downward direction. The reaction to this downward force lifts the second column 24 from its present position to an upper position. Simultaneously, the carriage member 46 is lifted by the flexible tension member 58. This combination of movement of the second column and the simultaneous relative movement of the carriage member 46 results in a displacement of the carriage member 46, which is twice the displacement of the second column. The uppermost position of the carriage member 46 is shown in dashed outline. The travel of the carriage member 46 is limited by a stop 80 and/or a limit switch, not shown. A pneumatic motor 64 is preferred because it has self limiting features. The use of a right angle gear reducer having a worm and worm wheel arrangement is preferred because of its self-locking or back-stopping capability. In the above example, the second column 24 may be retracted to a selected lower position by reversing the direction of the output shaft of the gear motor 52.

Figure 4:
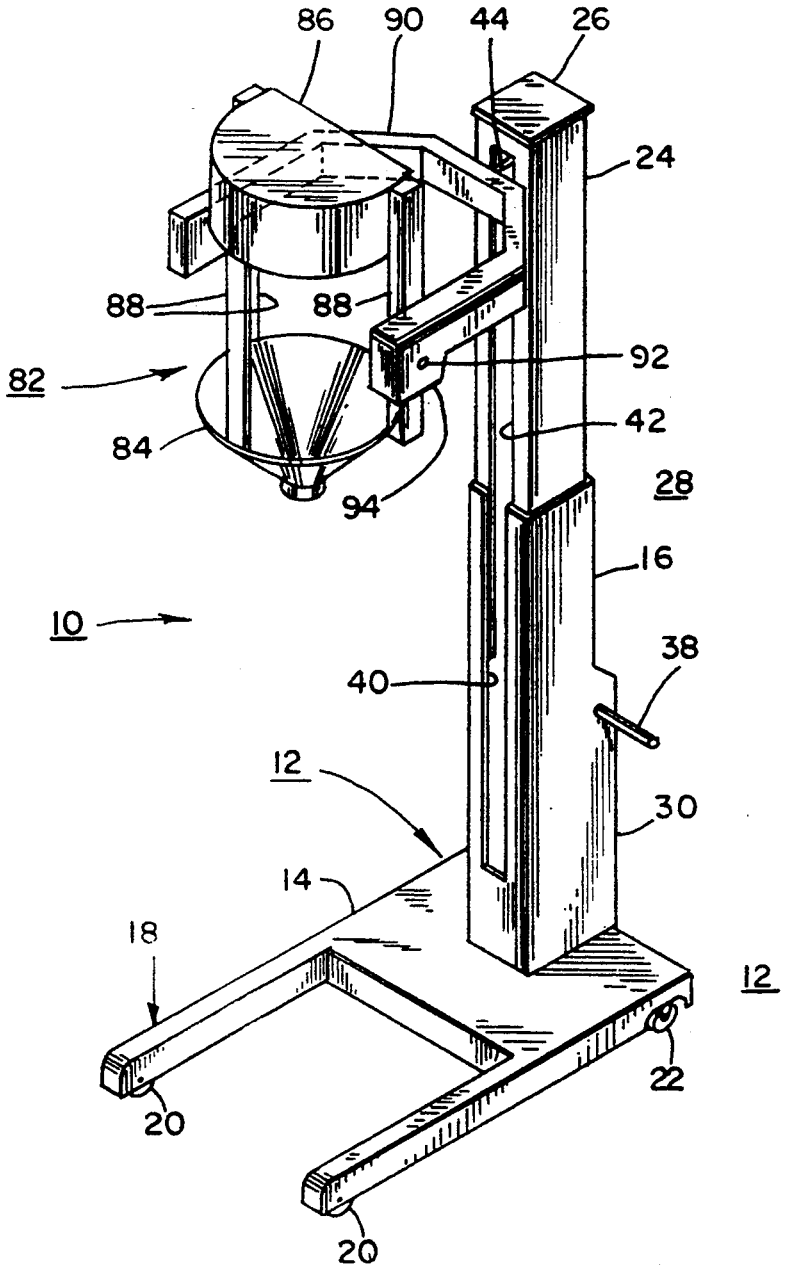
FIG. 4 represents an isometric view of one embodiment of the present invention, this view showing a second column in an extended condition and a container support being tilted to an inverted condition.

One type of a container support 82 is illustrated in FIGS. 1 and 4. This container support 82 includes a conically shaped hopper 84; a container shelf 86; and a plurality of struts 88. This container support 82 is pivotally mounted in trunnion fashion to a furcated arm assembly 90. The furcated arm assembly 90 is removably secured to the container support mounting means 44.

The trunnion mounting arrangement allows the container support to be tilted or pivoted about an axis of a pivoting shaft 92. The container support 82 preferably includes a means for retaining the container during tilting to a discharging position. This retaining means may include manually operated clamps, retaining chains, or a powered elevating shelf portion of the container shelf 86. The tilting of the container support 82 may be manually controlled in the case of light loads or powered. The powered tilting or inversion means such as a gear motor, not shown, would be housed interior of the end 94 of the furcated arm assembly 90.

It is to be noted that other types of container supports may be used with the present invention. One type of alternate container support is shown in U.S. Pat. No. 5,205,699. The carriage member 46 would need to be modified to include the features of the carriage member shown in U.S. Pat. No. 5,205,699. A second alternate container support, not shown, would include mounting of a conical hopper similar to 84 in trunnion fashion to the furcated arm 90. This second alternate container support would require a plurality of clamp members arrayed around the large diameter of the conical hopper. These clamp member would engage a flange at the mouth of the container.

As previously mentioned the present invention has most of its advantages when used in a mobile fashion. A mobile apparatus preferably includes a pair of retractable locking feet 96. However it is contemplated that some application may require a stationary mounting of the base member.

Referring again to FIG. 2, as previously mentioned, it is preferred that this apparatus be pneumatically powered and controlled. This type of power and control is very desirable in many applications. It has been found that the mounting of a grooved roller 98 to the second column 24 aids in controlling the path of a plurality of flexible conduits which are needed to supply the various air motors and position sensors needed in the operation of the apparatus.

Figure 2:
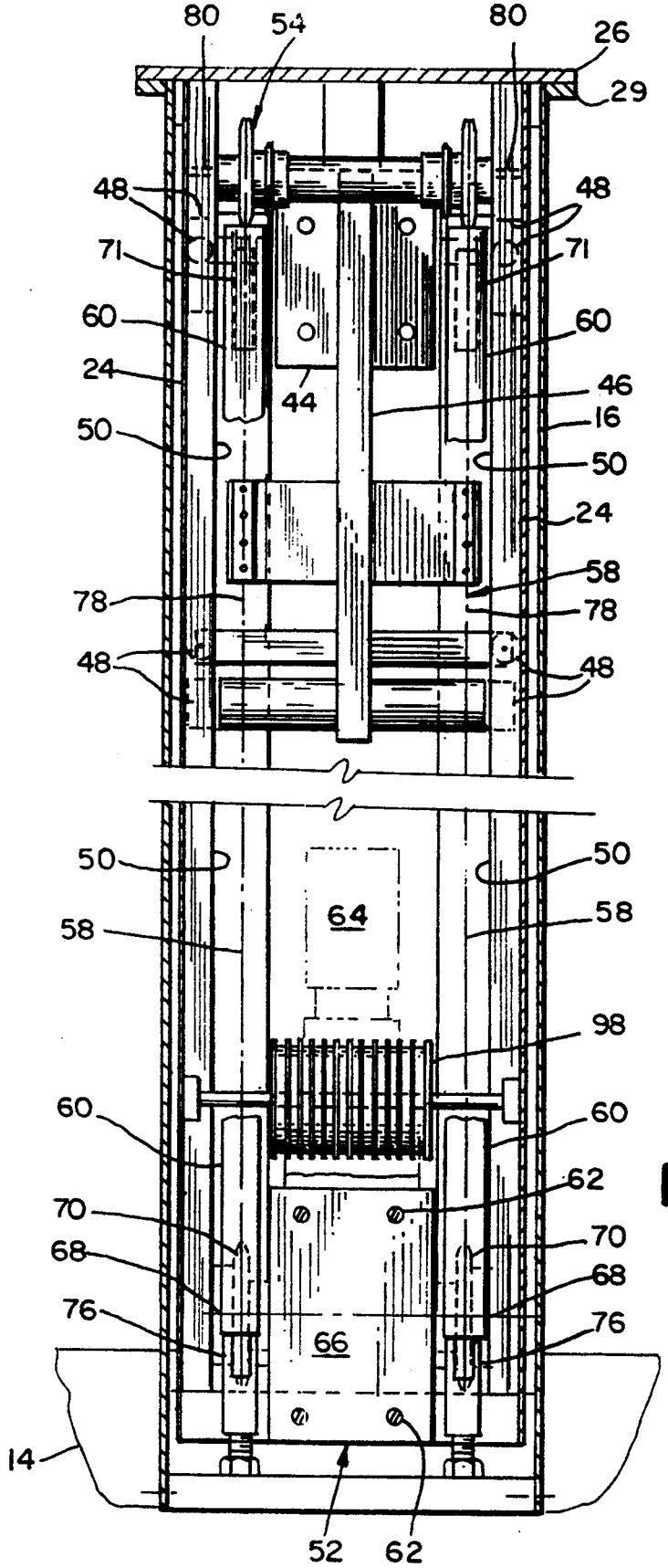
FIG. 2 represents a rear elevational view of the present invention, this view being taken substantially along line 2—2 of FIG. 1.

A preferred embodiment of a lifting and tilting apparatus has been shown or described. It is anticipated that mounting position for the gear motor assembly 52 and the driven assembly may be reversed within the second column. It is believed that the preferred arrangement as shown in FIG. 2 provides a more stable apparatus.

It is also to be noted that the discharging end of the conical hopper 84 may include a manual or powered valve means 100. This valve means 100 would be used to control the volume of any discharge from a container.

It also to be noted that it is preferred that the driven assembly 54 be attached to the second column 24 by way of a take-up adjustment, which has not been shown. A conventional threaded take-up mounting may be used. This take-up adjustment allows the operator to maintain the flexible tension member in a taut condition.

Terms such as "left", "right", "up", "down", "bottom", "top", "front", "back", "in", "out", and the like are applicable to the embodiments shown and described in conjunction with the drawings. These terms are merely for the purpose of description and do not necessarily apply to the position in which the lifting and tilting apparatus of the present invention may be utilized.

While a particular embodiment of the present invention has been shown and described, it is to be understood that the invention is not limited thereto and protection is sought to the broadest extent the prior art allows.

What is claimed is:

1. A telescoping apparatus for lifting a container of flowable material carried thereon comprising:

(a) a base assembly including a base member and first elongated tubular column, an axis of the first elongated tubular column being arrayed in a substantially vertical position while being secured to said base member;

(b) a second elongated tubular column configured so as to be slidably positioned within said first tubular column in a telescopic fashion;

(c) a slot formed in a wall of each of the first elongated tubular column and the second elongated tubular column, each slot being elongated and having its axis in substantial alignment with the other slot while providing an access opening to an interior of the first elongated tubular column and the second elongated tubular column;

(d) a container support being configured to receive and support the weight of a container;

(e) means for retaining the container in a placed condition during lifting of the container;

(f) a carriage member being moveably positioned within the interior of the second elongated tubular column, said carriage member having a plurality of guide rollers being selectively positioned and rotatably secured thereto;

(g) at least two U-shaped channel members, each of said U-shaped channel members being aligned on an interior wall of the second elongated tubular column in opposed relationship to each other for providing guideways for each of the guide rollers secured to the moveable carriage member;

(h) a selectively actuated lifting and lowering means which includes a reversible rotary gear motor being secured to a selected first interior portion of said second tubular column, a driven member assembly being rotatably attached to a selected second interior portion of said second tubular column, said reversible gear motor having at least one output shaft with a driver member carried thereon, a flexible tension member connecting said driver member with said driven member assembly in an endless array, an elongated lift bar having one of its ends being attached to a selected portion of a first segment of said flexible tension member, a distal end of said elongated lift bar being attached to a selected portion of said base assembly, said carriage member being attached to a selected portion of a second segment of said flexible tension member; and wherein said second tubular column is linearly positioned with respect to said base assembly in response to a movement of said flexible tension member by selective rotation of said driver member, said container support being simultaneously positioned with respect to said base assembly by the carriage member.

2. An apparatus as recited in claim 1 wherein said container support is configured for tilting the container to a selected position.

3. An apparatus as recited in claim 2 wherein said container support further includes a conical discharge hopper, a container shelf, a plurality of struts, and a furcated arm assembly; said conical discharge hopper and said container shelf being held in spaced relationship by said struts; and wherein an assembly of said conical hopper, said container shelf, and said struts is pivotally attached to said furcated arm assembly in trunnion fashion.

4. An apparatus as recited in claim 3 wherein said container support further includes a powered tilting means which is mounted interiorly of one end of the furcated arm assembly.

5. An apparatus as recited in claim 3 wherein said conical hopper further includes a valve means for selectively controlling the flow of any material being discharged from the container,

6. An apparatus as recited in claim 2 wherein said container support further includes a conical hopper, said conical hopper including a valve means for selectively controlling the flow of any material being discharged from said container.

7. An apparatus as recited in claim 2 wherein said lifting and tilting actions are pneumatically controlled and operated.

8. An apparatus as recited in claim 1 wherein said base assembly includes a plurality of wheels and a plurality of casters for transporting said apparatus.

9. An apparatus as recited in claim 1 wherein said base member includes a furcated extending portion for allowing floor level front placement and removal of the container.

10. An apparatus as recited in claim 1 wherein said reversible rotary gear motor includes a right angle worm gear reducer.

11. An apparatus as recited in claim 1 wherein said reversible rotary gear motor includes a pneumatically operated motor portion.

12. An apparatus as recited in claim 1 wherein said flexible tension means is a roller chain which is placed in a predetermined taut condition by an adjusting means.

13. An apparatus as recited in claim 1 wherein said distal end of said elongated lift bar includes a clevis mounting means having adjusting capabilities.

14. An apparatus as recited in claim 1 wherein said reversible rotary gear motor has two output shafts and said lifting and lowering means includes two of said flexible tension members being held in spaced relationship with each other and two of said elongated lift bars.

* * * * *